US009004044B2

(12) United States Patent
Langenbach et al.

(10) Patent No.: US 9,004,044 B2
(45) Date of Patent: Apr. 14, 2015

(54) METHOD FOR SUPPLYING A HIGH-PRESSURE PUMP IN A FUEL INJECTION SYSTEM OF AN INTERNAL COMBUSTION ENGINE WITH FUEL AND FUEL INJECTION SYSTEM

(75) Inventors: Christian Langenbach, Erbstetten (DE); Marcus Kristen, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 439 days.

(21) Appl. No.: 13/521,200

(22) PCT Filed: Jan. 3, 2011

(86) PCT No.: PCT/EP2011/050017

§ 371 (c)(1),
(2), (4) Date: Jul. 9, 2012

(87) PCT Pub. No.: WO2011/098305

PCT Pub. Date: Aug. 18, 2011

(65) Prior Publication Data

US 2013/0025569 A1 Jan. 31, 2013

(30) Foreign Application Priority Data

Feb. 11, 2010 (DE) ..... 10 2010 001 834

(51) Int. Cl.
*F02M 37/04* (2006.01)
*F02M 63/00* (2006.01)
(Continued)

(52) U.S. Cl.
CPC ..... *F02M 63/0001* (2013.01); *F02D 41/3854* (2013.01); *F02M 37/0052* (2013.01);
(Continued)

(58) Field of Classification Search
CPC ..... F02M 63/0225; F02M 63/0265
USPC ..... 123/456, 457, 458, 497, 446, 506, 514
See application file for complete search history.

(56) References Cited

U.S. PATENT DOCUMENTS

| | | | | |
|---|---|---|---|---|
| 6,135,090 | A * | 10/2000 | Kawachi et al. | 123/446 |
| 6,422,212 | B1 * | 7/2002 | Faix et al. | 123/506 |
| 6,609,500 | B2 | 8/2003 | Ricco et al. | |
| 7,438,057 | B2 | 10/2008 | Scheurer et al. | |
| 8,371,267 | B2 | 2/2013 | Kristen et al. | |

(Continued)

FOREIGN PATENT DOCUMENTS

| | | |
|---|---|---|
| DE | 102007006945 | 8/2008 |
| WO | 2011012356 | 2/2011 |

OTHER PUBLICATIONS

PCT/EP2011/050017 International Search Report dated Mar. 25, 2011 (Translation and Original, 6 pages).

*Primary Examiner* — John Kwon
(74) *Attorney, Agent, or Firm* — Michael Best & Friedrich LLP

(57) ABSTRACT

The invention relates to a method for supplying a high-pressure pump (1) in a fuel injection system of an internal combustion engine with fuel, wherein for delivery and for controlling the delivered quantity a delivery pump (3) is used, wherein said delivery pump is arranged in a low-pressure circuit (2) and operated by an electric motor and by means of which, depending on the respective selected engine speed, a certain quantity of fuel is fed to the high-pressure pump (1), in which the fuel is first compressed and then fed to a fuel high-pressure accumulator (4). According to the invention, the fuel pressure on the intake side of the high-pressure pump (1) is controlled by means of a pressure control valve (5), wherein a supply of the high-pressure pump (1) with fuel for lubrication and/or cooling via the low-pressure circuit (2) and the delivery pump (3) is assured when the pressure control valve (5) is in the closed position. The invention further relates to a fuel injection system.

11 Claims, 1 Drawing Sheet

(51) Int. Cl.

| | |
|---|---|
| ***F02D 41/38*** | (2006.01) |
| ***F02M 37/00*** | (2006.01) |
| ***F02M 59/44*** | (2006.01) |
| ***F04B 1/06*** | (2006.01) |
| ***F04B 23/10*** | (2006.01) |

(52) U.S. Cl.

CPC ..... *F02M59/44* (2013.01); *F02M 2200/02* (2013.01); *F02M 2200/28* (2013.01); *F04B 1/06* (2013.01); *F04B 23/10* (2013.01); *F04B 2205/01* (2013.01); *F04B 2205/063* (2013.01)

(56) References Cited

U.S. PATENT DOCUMENTS

| | | | | |
|---|---|---|---|---|
| 2002/0088437 | A1* | 7/2002 | Ricco et al. | 123/457 |
| 2002/0174855 | A1* | 11/2002 | Djordjevic | 123/458 |
| 2003/0089341 | A1 | 5/2003 | Schueler | |
| 2005/0199219 | A1 | 9/2005 | Utsumi | |
| 2006/0137657 | A1* | 6/2006 | Ricco et al. | 123/458 |
| 2007/0283928 | A1* | 12/2007 | Ricco et al. | 123/446 |
| 2008/0115766 | A1* | 5/2008 | Ricco et al. | 123/457 |
| 2009/0064971 | A1* | 3/2009 | Ricco et al. | 123/446 |

* cited by examiner

METHOD FOR SUPPLYING A HIGH-PRESSURE PUMP IN A FUEL INJECTION SYSTEM OF AN INTERNAL COMBUSTION ENGINE WITH FUEL AND FUEL INJECTION SYSTEM

BACKGROUND OF THE INVENTION

The invention relates to a method for supplying fuel to a high pressure pump in a fuel injection system of an internal combustion engine, wherein for delivery and delivery quantity control, a delivery pump is used which is driven by an electric motor and arranged in a low pressure circuit. Furthermore, the invention relates to a fuel injection system, in particular a common rail injection system of an internal combustion engine.

A device of the type cited initially is disclosed for example in EP 1 195 514 A2 which concerns a device for controlling the flow from a high pressure pump in a common rail fuel injection system of an internal combustion engine. For this, said device comprises a delivery pump which is driven by an electric motor and, controlled by a control unit, delivers a particular quantity of fuel to a high pressure pump. Depending on the delivery quantity of the delivery pump, a choke arranged on the suction side of the high pressure pump specifies the delivery pressure which rises or falls in proportion to the delivery quantity. The diameter of the choke is determined from established test results according to the requirements.

One advantage of using an electric motor driven pump as a delivery pump is in particular that such a pump allows precise quantity control. Actuating elements normally used for quantity metering, such as for example a dosing unit, can therefore be omitted. This in turn allows a reduction in the number of components, in particular electrical/electronic components, and the number of necessary connections and lines.

Furthermore such an electric fuel pump allows control to be tailored to demand, which reduces the power loss. In overrun mode, for example, the delivery quantity can be reduced to zero in order also to lower the high pressure quantity to zero. Corresponding control of the delivery pump is not however possible if high pressure fuel pumps are used which require a certain minimum fuel supply, for example for lubrication and/or cooling.

The fuel injection system described in EP 1 195 514 A2 has a lubricant line incorporated in the low pressure circuit, via which the high pressure pump is supplied with fuel for lubrication. The supply of fuel for lubrication is however linked to certain high pressure delivery quantities which must be maintained, otherwise constant lubrication is not guaranteed.

SUMMARY OF THE INVENTION

Starting from said prior art, the invention is based on the object of providing a method for supplying fuel to a high pressure pump, which ensures a fuel supply sufficient for lubrication and/or cooling of the high pressure pump almost irrespective of the high pressure quantity delivered. Furthermore a fuel injection system suitable for implementation of the method is specified, which system is simply constructed and can be operated with low power loss.

The method proposed for supplying fuel to a high pressure pump is characterized according to the invention in that the fuel pressure is regulated by means of a pressure regulation valve arranged on the suction side of the high pressure pump, wherein with the pressure regulation valve in the closed position, a supply of fuel to the high pressure pump for lubrication and/or cooling is ensured via the low pressure circuit and delivery pump. This means that the delivery quantity supplied to the high pressure pump for compression can be reduced to zero by closing the pressure regulation valve but nonetheless a sufficient quantity of fuel is provided for lubrication and/or cooling of the high pressure pump. Thus in combination with an electric fuel pump as delivery pump, high pressure pumps can be used which require a specific minimum fuel supply. Also power losses can be reduced by demand-tailored control of the delivery pump driven by an electric motor. Demand-tailored control means that the delivery quantity of the delivery pump can be reduced to a quantity necessary for lubrication and/or cooling if also no fuel is to be delivered at high pressure.

In addition, the advantages already cited in relation to the use of electric fuel pumps apply. If the electric fuel pump is used, for example, for quantity control, no separate dosing unit is required. The number of electrical/electronic components is thus reduced. Furthermore the arrangement of a pressure regulation valve on the rail or high pressure fuel accumulator can be omitted. Pressure regulation is now performed by the pressure regulation valve arranged on the suction side of the high pressure pump according to the invention. By reducing the number of electrical/electronic components, the necessary connections or plug contacts are also reduced. Consequently, the construction of a fuel injection system suitable for implementation of the method according to the invention is also simplified.

Closing the pressure regulation valve allows not only a reduction to zero of the high pressure quantity delivered, while a sufficient quantity of fuel for lubrication and/or cooling remains in the low pressure region, but counters the propagation of pressure pulses which in particular occur at high rotation speeds and which under some circumstances can lead to an undesirable high pressure delivery quantity. The method is therefore suitable above all in conjunction with fuel injection systems in which high dynamic pumps are used. Such pumps usually also require an improved lubrication and/or cooling of their components.

Usually lubrication and/or cooling must be ensured above all for the bearing points formed in the housing of the high pressure pump to receive the drive shaft. According to the proposed method, here the fuel is first supplied to a central pump chamber, from where it is distributed to the two shaft bearing points. Excess fuel is diverted via lines to a return circuit. In addition, further components can be lubricated and/or cooled.

Preferably the pressure regulation valve is designed such that in the closed position of the pressure regulation valve, lubrication and/or cooling of the high pressure pump is ensured via the opening pressure of the pressure regulation valve. Only when the opening pressure is exceeded is fuel supplied to the high pressure pump for compression. Below the opening pressure, there is no output quantity and hence no high pressure quantity, but in the low pressure region a residual pressure remains which can be used for lubrication and/or cooling. In this way, even with a low delivery quantity of the delivery pump, an almost constant lubrication and/or cooling of the high pressure pump can be guaranteed. If the rotation speed of the electric fuel pump rises, the delivery quantity rises and with it the pressure, so that consequently the pressure regulation valve opens and fuel is supplied to the high pressure pump for compression. The high pressure quantity is thus defined via the curve of the pressure regulation valve. The curve and hence the static and/or dynamic behavior of the pressure regulation valve is selected according to the requirements. Preferably a steep curve is selected in order to achieve a slight pressure rise and simultaneously a strong piston damping when the delivery quantity is increased. The requirements may however also justify a different design of the pressure regulation valve.

In addition, measures are preferred for compensating for leaks in the region of the pressure regulation valve. Such measures can, for example, comprise the arrangement of a further pressure regulation valve on the rail or high pressure fuel accumulator, the use of a zero delivery choke and/or corresponding control of the injectors.

According to a preferred embodiment of the invention, to improve the lubrication and/or cooling of the high pressure pump a two-stage pressure regulation valve is used. This two-stage design is preferably implemented by linking the pressure regulation valve to a return circuit. If part of the delivery quantity is diverted to the return circuit via the pressure regulation valve, the requested delivery quantity also rises. This in turn leads to an increased throughput and hence to improved lubrication and/or cooling. The lubrication or cooling power also rises with the fuel quantity. The pressure regulation valve is preferably linked to the return circuit via a choke.

Alternatively or additionally, to improve lubrication and/or cooling, a choke can be used which is connected in parallel to a lubrication and/or cooling line. By this measure, the throughput and hence with this the lubrication and/or cooling power is increased. The difference from a two-stage design of the pressure regulation valve lies in that the quantity increase is not dependent on a specific switch position of the pressure regulation valve but is constant. The proposed measure is consequently suitable in particular for heavy duty pumps.

Furthermore, at least one further choke can be arranged in a lubrication and/or cooling line for flow restriction.

The fuel injection system also proposed for achieving the object cited initially is characterized according to the invention in that on the suction side of the high pressure valve, a pressure regulation valve is provided to regulate the fuel pressure, wherein with the pressure regulation valve in the closed position, a sufficient quantity of fuel for lubrication and/or cooling of the high pressure pump is ensured via the low pressure circuit and the delivery pump. This assumes that the pressure regulation valve is integrated into the low pressure circuit such that even in the closed position of the pressure regulation valve, fuel reaches the components to lubricate and/or cool these. Preferably the fuel quantity provided for lubrication and/or cooling is distributed via a central pump chamber. From here the fuel can be supplied for example to the bearing points of a drive shaft held in the pump housing. Alternatively or additionally, separate lubrication and/or cooling lines can be provided for distribution of the fuel.

According to a preferred embodiment of the invention, the pressure regulation valve is constructed with two stages. The two-stage design can for example be achieved by linking the pressure regulation valve to a return circuit, wherein further preferably, the linking takes place via a choke. As part of the delivery quantity is diverted via the choke to the return circuit, the throughput and hence the lubrication and/or cooling power can be increased.

Alternatively or additionally, a choke can be provided which is connected in parallel to a lubrication and/or cooling line. Also a choke can be arranged in a lubrication and/or cooling line for flow restriction. These measures also ensure an improvement or increase in the lubrication and/or cooling power.

Further preferably, the specified fuel injection system is suitable for performance of the method described above according to the invention. The advantages mentioned in connection with the method therefore apply accordingly to the fuel injection system.

BRIEF DESCRIPTION OF THE DRAWINGS

Preferred embodiments of the invention are explained in more detail below with reference to the two drawings. These show.

DETAILED DESCRIPTION OF THE DRAWINGS

Figure 1:
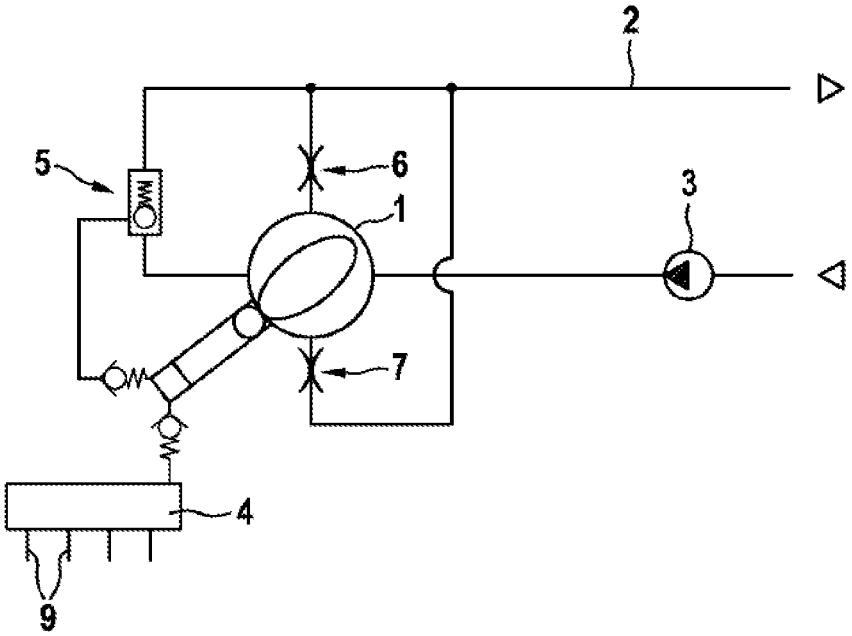
FIG. 1 a diagrammatic depiction of a fuel injection system according to a first embodiment of the invention, and FIG. 2 a diagrammatic depiction of a fuel injection system according to a second embodiment of the invention.

The first embodiment of a fuel injection device according to the invention shown diagrammatically in FIG. 1 comprises a high pressure pump 1 formed as a piston pump which is supplied with fuel via a low pressure circuit 2. As an example, a high pressure pump 1 with a pump piston 10 is shown. Alternatively, the high pressure pump 1 can also be formed as a multi-piston pump. The piston(s) is (are) arranged preferably radially about a drive shaft with a cam or eccentric 11 and supported on the cam or eccentric 11 via a roller 12 and/or a tappet body so that rotation of the drive shaft causes a stroke movement of the piston(s) 10.

The injection system shown furthermore comprises a delivery pump 3 which is driven by an electric motor and in the present case is used to deliver fuel and to control the delivery quantity. No separate dosing unit is thus required. The pressure regulation takes place via a pressure regulation valve 5 arranged on the suction side of the high pressure pump 1. The fuel provided for compression is supplied via the pressure regulation valve 5 and a supply valve 13 formed as a non-return valve to a pump working chamber 14 of the high pressure pump 1. There the fuel is compressed by the stroke movement of the piston 10 and supplied via an outlet valve 15 (also formed as a non-return valve) to a high pressure fuel accumulator 4. The fuel is injected into the combustion chamber of an internal combustion engine via a plurality of fuel injectors 9 connected to the high pressure fuel accumulator 4.

In the closed position of the pressure regulation valve 5, no fuel is supplied to the pump working chamber 14 of the high pressure pump 1 for compression. However, adequate lubrication and/or cooling of the high pressure pump 1 is ensured via the low pressure circuit 2 and the delivery pump 3 driven by an electric motor. Because even with the pressure regulation valve 5 in the closed position, fuel continues to reach a central pump chamber 16 containing the drive shaft, so that via the pump chamber 16 the bearing points 8 of the drive shaft formed in the housing of the high pressure pump 1 are supplied with sufficient fuel for lubrication and/or cooling. In the present case, lubrication and/or cooling lines 7 are arranged in the housing of the high pressure pump 1 and also connected with a return circuit 17 to discharge surplus fuel.

The fuel injection system shown according to the invention allows the use of a high pressure pump 1 which requires a constant fuel supply, for example, for lubrication and/or cooling of its components. As this is guaranteed by connecting the pressure regulation valve according to the invention, the delivery pump 3 driven by electric motor can be controlled demand-tailored i.e. the delivered high pressure quantity can be reduced to zero without damaging the high pressure pump 1.

Figure 2:
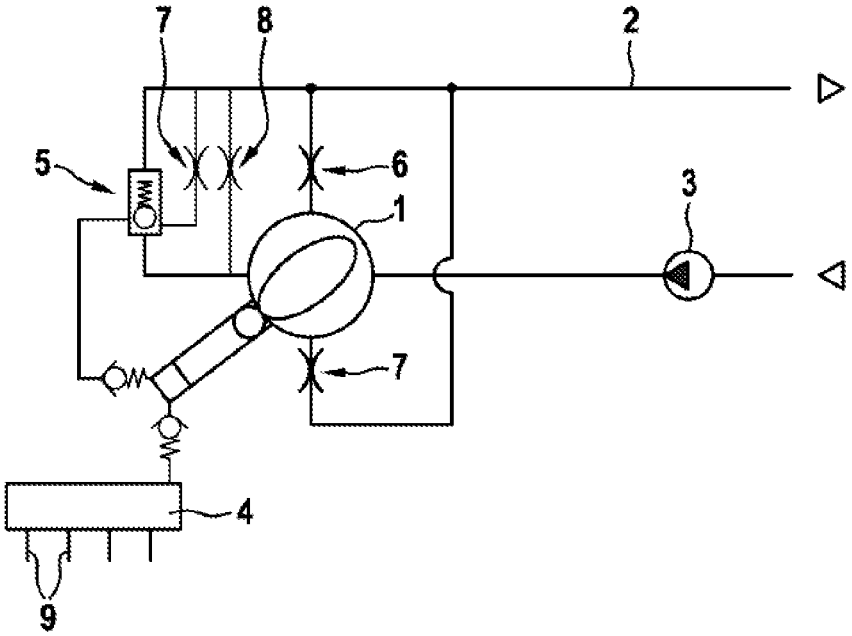

FIG. 2 shows a further embodiment of a fuel injection system according to the invention. In contrast to the embodiment in FIG. 1, here the pressure regulation valve 5 is formed in two stages in that the pressure regulation valve 5 is linked to the return circuit 17 via a choke 6. If in a specific switch position of the pressure regulation valve 5, at least a part flow of the delivery quantity is supplied via the choke 6 to the return circuit 17, the quantity demand rises and with it the lubrication and/or cooling power. To increase the fuel quantity and hence with it the lubrication and/or cooling power irrespective of the switch position of the pressure regulation valve 5, as explained above, alternatively or additionally, a further choke 6 can be used which is connected in parallel.

The invention claimed is:

1. A method for supplying fuel to a high pressure pump (1) in a fuel injection system of an internal combustion engine, wherein for delivery and for delivery quantity control, a delivery pump (3) is used which is driven by an electric motor and arranged in a low pressure circuit (2) and by means of which, depending on the motor rotation speed selected, a specific quantity of fuel is supplied to the high pressure pump (1), in which the fuel is first compressed and then supplied to a high pressure fuel accumulator (4), characterized in that the fuel pressure is regulated by a pressure regulation valve (5) arranged on a suction side of the high pressure pump (1), wherein with the pressure regulation valve (5) in a closed position, a supply of fuel to the high pressure pump (1) is still ensured for at least one of lubrication and cooling via the low pressure circuit (2) and the delivery pump (3).

2. The method as claimed in claim 1, characterized in that with the pressure regulation valve (5) in the closed position, the at least one of lubrication and cooling of the high pressure pump (1) is ensured via an opening pressure of the pressure regulation valve (5).

3. The method as claimed in claim 1, characterized in that a high pressure quantity is defined via a curve of the pressure regulation valve (5).

4. The method as claimed in claim 1, characterized in that leakages in a region of the pressure regulation valve (5) are compensated for by at least one of arranging a further pressure regulation valve on the high pressure fuel accumulator (4), use of a zero delivery choke, and corresponding control of injectors.

5. The method as claimed in claim 1, characterized in that, to improve the at least one of lubrication and cooling of the high pressure pump (1), a two-stage pressure regulation valve (5) is used.

6. The method as claimed in claim 1, characterized in that, to improve the at least one of lubrication and cooling of the high pressure pump (1), a choke (6) is used which is connected in parallel to a lubrication and cooling line (7).

7. The method as claimed in claim 1, characterized in that, for flow restriction, a choke (6) is used which is arranged in a lubrication and cooling line (7).

8. A fuel injection system of an internal combustion engine, with a high pressure pump (1) which delivers fuel at high pressure and supplies the fuel to a high pressure fuel accumulator (4), and with a delivery pump (3) driven by electric motor and arranged in a low pressure circuit (2) to supply fuel to the high pressure pump (1), wherein a delivery quantity can be regulated via the delivery pump (3), characterized in that a pressure regulation valve (5) is provided on a suction side of the high pressure pump (1) to regulate the fuel pressure, wherein when the pressure regulation valve (5) is in a closed position, a sufficient quantity of fuel for at least one of lubrication and cooling of the high pressure pump (1) is ensured via the low pressure circuit (2) and the delivery pump (3).

9. The fuel injection system as claimed in claim 8, characterized in that the pressure regulation valve (5) is constructed in two stages.

10. The fuel injection system as claimed in claim 8, characterized in that at least one choke (6) is at least one of arranged in a lubrication and cooling line (7) and connected in parallel thereto.

11. The fuel injection system as claimed in claim 8, characterized in that the fuel injection system is a common rail injection system.

* * * * *